US005617980A

United States Patent [19]

Parsons et al.

[11] Patent Number: 5,617,980

[45] **Date of Patent: *Apr. 8, 1997**

[54] BATON LOCKING MECHANISM FOR EXPANDABLE BATON CARRIERS

[75] Inventors: Kevin L. Parsons; Jerome J. Weber, both of Appleton, Wis.

[73] Assignee: Armament Systems and Procedures, Inc., Appleton, Wis.

[ * ] Notice: The term of this patent shall not extend beyond the expiration date of Pat. No. 5,449,104.

[21] Appl. No.: 401,101

[22] Filed: Mar. 8, 1995

Related U.S. Application Data

[62] Division of Ser. No. 216,745, Mar. 23, 1994, Pat. No. 5,449,104.

[51] Int. Cl.[6] ..... A45F 5/00

[52] U.S. Cl. ..... 224/251; 224/678; 224/914; 403/325; 403/374

[58] Field of Search ..... 224/232, 245, 224/247, 251, 252, 253, 269, 904, 914; 24/524, 136 R, 641, 642; 403/233, 234, 236, 373, 374, 325, 353, 409.1; 248/316.2, 316.3, 230.2, 321.31, 229.11

[56] References Cited

U.S. PATENT DOCUMENTS

| | | | |
|---|---|---|---|
| 3,049,367 | 8/1962 | Lashta | 403/325 |
| 3,467,352 | 9/1969 | Bohler | 248/230.2 |
| 3,628,221 | 12/1971 | Pasbrig | 403/325 |
| 3,811,155 | 5/1974 | Stafford | 403/374 |
| 4,528,768 | 7/1985 | Anderson | 403/374 |
| 4,708,309 | 11/1987 | Walter | 403/233 |
| 4,955,518 | 9/1990 | Parson et al. | 224/914 |
| 5,108,066 | 4/1992 | Lundstrom | 24/524 |
| 5,398,946 | 3/1995 | Quiring | 403/325 |
| 5,449,104 | 9/1995 | Parson et al. | 224/253 |

*Primary Examiner*—Henry J. Recla
*Assistant Examiner*—Gregory M. Vidovich
*Attorney, Agent, or Firm*—Robert C. Curfiss; Mark A. Tidwell; Butler & Binion, L.L.P.

[57] ABSTRACT

A baton carrier for expandable batons is constructed for receiving and stowing expandable batons when in either the retracted or expanded position. The baton is received in a cylindrical holder having a bottom constructed such that a retracted baton cannot pass through the bottom when retracted, but the inner shafts of the baton can pass through the bottom when extended. A friction shoe positively secures the baton in the holder by pushing against the baton. A cinch bar is used to selectively lock the friction shoe. A belt attachment assembly secures the holder to the belt of the user.

7 Claims, 6 Drawing Sheets

16
26
24
88
62
64
54
55
58
96
90
92
75
70
71
100
20
110
18
54
55
56
58
98
56
89
22
74
87
108
94
120
118
81
84
84
69
13
102
77
86
82
76
66
83
68
133
134
78
130
132

FIG. 4
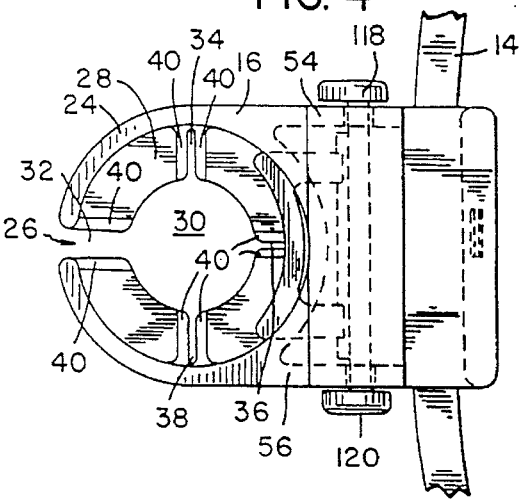
FIG. 8
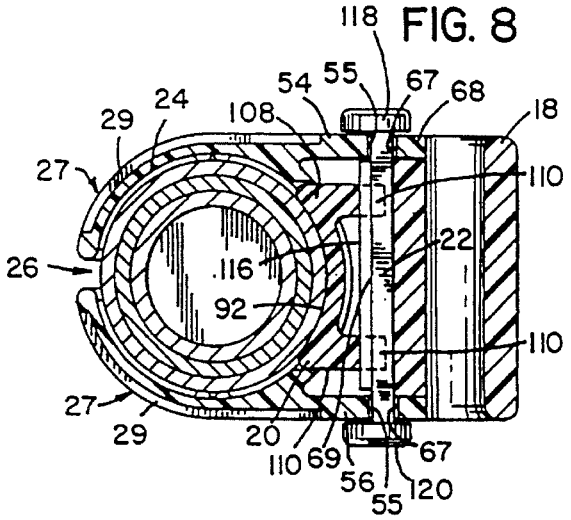
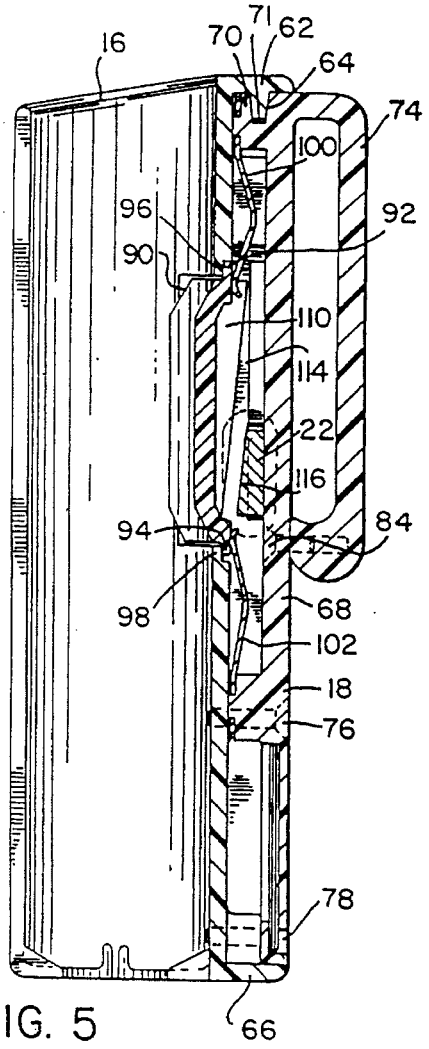
FIG. 5
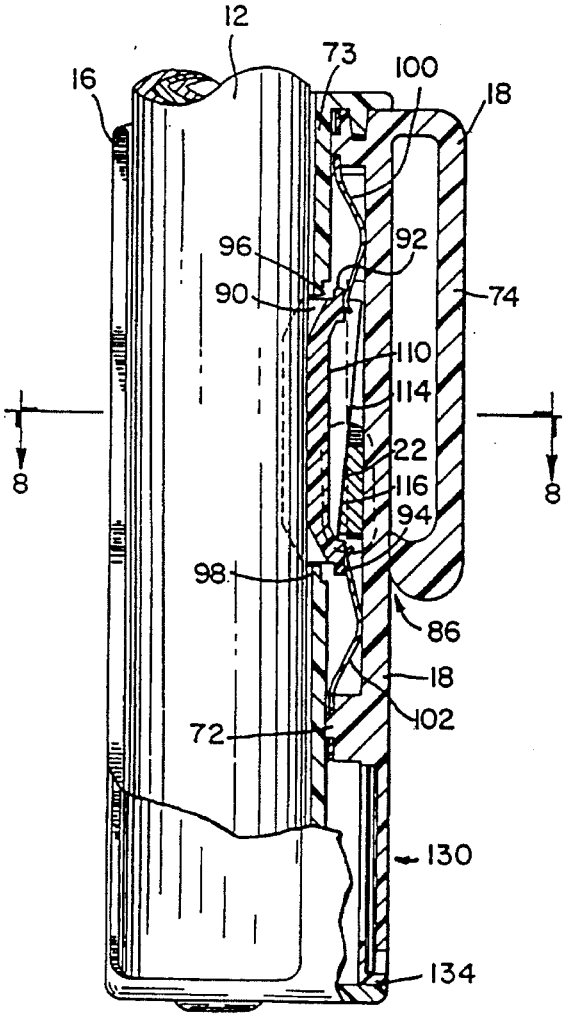
FIG. 6

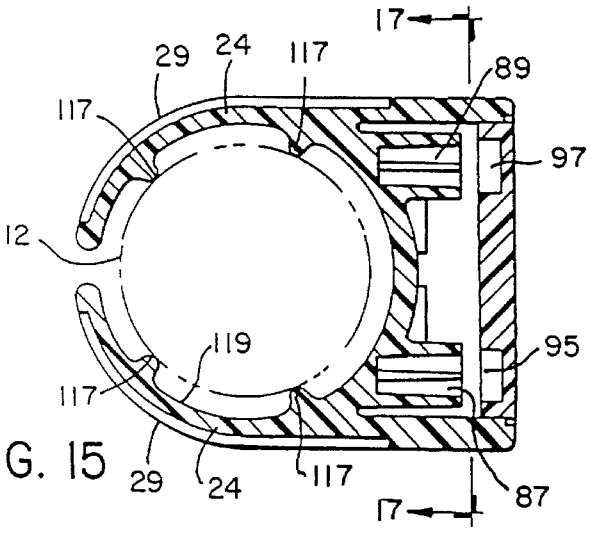
FIG. 15
FIG. 16
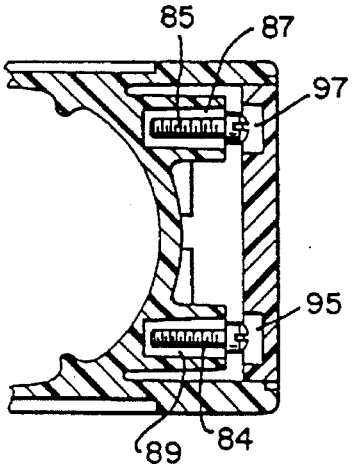
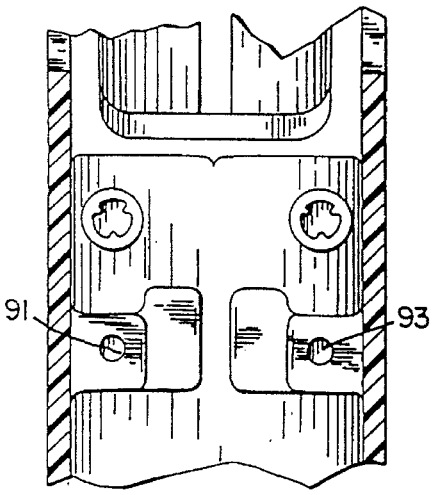
FIG. 17
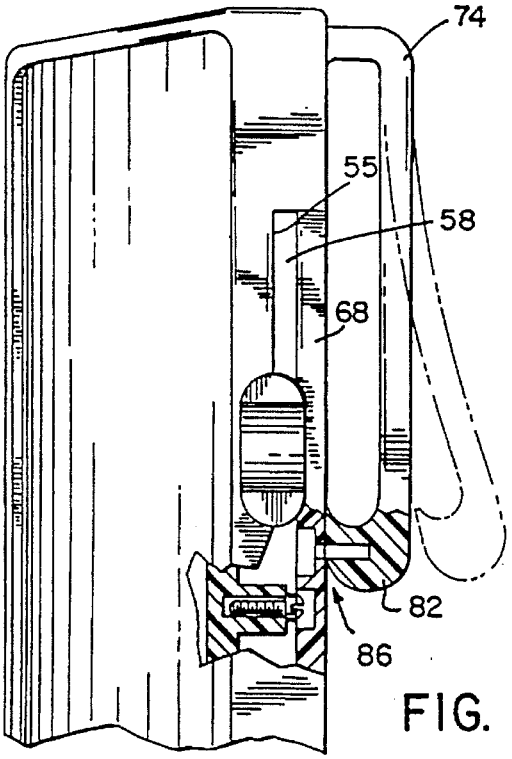
FIG. 18
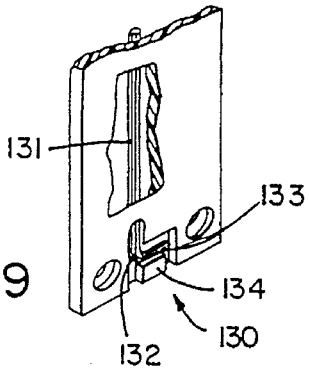
FIG. 19

BATON LOCKING MECHANISM FOR EXPANDABLE BATON CARRIERS

This application is a divisional of U.S. application 08/216,745 filed on Mar. 23, 1994, now U.S. Pat. No. 5,449,104.

BACKGROUND OF THE INVENTION

1. Field of the Invention

This invention is generally related to a baton carrier or scabbard for holding an expandable baton on the belt of law enforcement personnel as part of the official issue equipment and is specifically directed to a baton carrier for holstering an expandable baton in either the expanded or retracted condition.

2. Discussion of the Prior Art

Expandable batons are used primarily by law enforcement officers and security personnel. Typically expandable batons have a cylindrical handle and one or more telescoping cylindrical shafts that can be nested inside the larger handle when the baton is retracted. When an expandable baton is fully extended it usually locks in the extended position, and can be retracted only by sharply striking the end of the baton with an axial blow.

Batons come in various sizes. In particular, the diameter of the baton handle and the diameter of the telescoping shafts can vary. Usually a blunt, enlarged tip is located at the outer end of the innermost telescoping shaft of the expanded baton.

Baton carriers, or scabbards, are typically designed to be clipped to the belt of a person carrying a baton, and provides a sheath for stowing the baton in an at ready position. A baton carrier should be designed so that a baton cannot be inadvertently released from the carrier, or be taken by an adversary. It is thus important that baton carriers positively secure the baton within the carrier, while at the same time providing for a quick release of the baton for authorized use.

Typically, the carriers or scabbards of the prior art require that the baton be fully retracted for placement within the carrier. In some applications, it would be desirable to be able to store a baton both when it is retracted and when it is expanded. In most circumstances it is convenient for the baton to be retracted because a retracted baton is compact and permits generally unrestricted movement by the wearer. However, in certain applications, such as riot control operations and the like, it may be preferred to stow the baton in the expanded position. Also, it may be impractical to collapse the baton particularly where a hard surface is not available for striking the required sharp axial blow, such as in grassy fields or in marine operations such as in inflatable boats. Under these and similar circumstances, it would be desirable to be able to properly holster or stow the baton and to quickly withdraw the baton from the carrier both when it is expanded and when it is retracted, utilizing a single carrier.

Since all expandable batons do not have the same dimensions, it would also be desirable that a baton carrier be readily adapted to accommodate any of a number of various configurations.

To date, there are no known baton carriers or scabbards that consistently meet the above criteria. Therefore, there remains a need for a baton carrier that will accommodate a variety of batons while at the same time maintaining each of the batons properly in the carrier, permitting the baton to be readily stowed in either the expanded or retracted position.

SUMMARY OF THE INVENTION

A baton carrier made in accordance with the present invention provides a practical solution for both positively securing and easily withdrawing an expandable baton when it is either retracted or expanded. In addition, the carrier is readily adapted to carry any of a variety of batons on a variety of belts. It is a feature of the invention that the carrier can be locked in position on the belt, thus minimizing any tendency of the carrier to slip relative to the belt during use.

In the preferred embodiment of the invention, the carrier is designed to permit a retracted baton to be withdrawn axially from the carrier in the normal, well-known manner in much the same way as a knife is drawn from its sheath, while at the same time allowing for either axial or axial/radial removal of a fully extended baton. The carrier has an open side wall which is specifically designed so that it cannot spread sufficiently to permit lateral withdrawal of the enlarged handle but will spread sufficiently to permit the telescoping sections to pass. Specifically, the carrier of the present invention is designed to spread at its side by using the expanded baton as leverage in order to permit radial or lateral removal of the expanded baton. The limitations on the range of spread and the lack of available leverage when the baton is retracted prevent accidental radial removal of the retracted baton.

The baton carrier of the preferred embodiment includes a friction shoe or brake shoe for positively engaging and securing an expandable baton in the carrier whether the baton is retracted or expanded. Specifically, the carrier is defined by a hollow, cylindrical holder having an upper open end and an interior chamber adapted for accepting the baton. An expandable baton can be received in the chamber and is positioned along the longitudinal axis of the cylinder. The friction shoe is between the interior cylinder wall and the baton for engaging the baton and holding it in position in the chamber. It is an important aspect of the preferred embodiment of the invention that the friction shoe can be changed out, making the carrier adaptable for any of a variety of different sized batons. In the preferred embodiment, the friction shoe has a ramped surface facing away from the inside passage of the baton holder. In this embodiment, the baton carrier also has a cinch bar corresponding to the ramped surface of the friction shoe. Movement of the cinch bar is guided in a direction substantially parallel with the longitudinal axis of the interior passage for selectively displacing the friction shoe into the interior passage of the holder by moving the cinch bar. As the cinch bar is ramped up, the cinch bar pushes against the ramped surface on the friction shoe. This selectively increases the friction force of the shoe against the baton, effectively locking the baton in the carrier when desired.

The carrier also has a belt clip that is connected to the outer wall of the cylinder chamber. The belt clip has a loop through which a belt can pass to attach the baton carrier to the belt of a uniform or the like. In the preferred embodiment of the invention, the clip may also be changed out permitting the holder to be adapted to various belts for assuring a snug fit between the belt and the clip and minimizing slippage. Preferably, the clip is initially slightly bowed outwardly away from the cylinder chamber, providing an open or broken loop that permits the clip to slide over a belt. A closure feature is provided to draw the clip in toward the cylinder and tightly against the belt to frictionally hold the carrier in place on the belt.

It is contemplated that the baton carrier of the invention includes a closed bottom for supporting the tip of the baton to assure the baton does not improperly extend through the bottom of the cylinder chamber. In the preferred embodiment of the invention, the bottom of the holder includes a through hole which is normally smaller than the handle of the baton but large enough to accommodate the telescoping sections normally nested within the handle of a retracted baton. Preferably, the hole is slightly smaller than the tip of the baton, assuring that the baton will not accidentally partially extend with the tip falling through the hole. The bottom wall of the cylinder chamber is made of a rigid, resilient material such that when the baton is expanded, the tip can be forced through the hole and, in fact, the telescoping sections may also then pass through the hole, permitting an expanded baton to be stowed with the handle in the chamber in the same manner as the retracted baton but with the telescoping sections extending through the expanded hole. The additional leverage gained when the baton is extended makes it relatively easy to expand the through hole, while it is virtually impossible to expand the hole with the baton in the collapsed condition, due to both lack of leverage and the proximity of the tip to the enlarged handle. It has been found that it is helpful to provide a radius on the tip engaging wall of the through hole to assist in seating the tip when the hole is to be expanded by the extended baton.

Further in this aspect of the invention, it is preferred that the cylinder wall of the chamber have a longitudinal slit or opening extending its full length and a continuing radial slit in the bottom wall extending into the hole. This both accommodates enlargement of the hole for stowing the expanded baton and spreading of the chamber for lateral or radial withdrawal of the baton.

The invention includes several other features that are apparent from the detailed description. For instance, the invention discloses a reinforcing wall mechanism to securely attach the belt attachment member to the holder. The invention also discloses a closure device such as a screw clamp for securing the belt loop to the remainder of the belt attachment member.

Although the invention is particularly useful for carrying an expandable baton, it may also be adapted for carrying other equipment needed by law enforcement officials in the performance of their duties, such as, by way of example, flashlights or mace canisters or the like.

Accordingly, it is a primary object of this invention to provide a baton carrier that positively secures a baton in either the expanded or retracted condition.

Another object of this invention is to provide means for securing a belt attachment member to a baton carrier.

An additional object of this invention is to provide a convenient way to attach a loop clip around a belt without removing the belt from a uniform or the like.

Another object of this invention is to provide selective locking means for locking the baton in a carrier.

Another object of the invention is to provide a baton carrier that can be easily modified to accommodate various baton or belt sizes.

Other objects and advantages of the invention will become apparent upon reading the following detailed description and appending claims, and upon reference to the accompanying drawings.

BRIEF DESCRIPTION OF THE DRAWINGS

FIG. 4 is a top view of a baton carrier as shown in FIG. 1, with the baton removed;

FIG. 5 is a side plan view, partially fragmented, of a baton carrier in accordance with the present invention, within the baton removed;

FIG. 6 is a view similar to FIG. 5, with a baton stowed in the carrier;

FIG. 8 is a cross sectional view taken along line 8—8 of FIG. 6;

FIG. 15 is a cross-sectional view taken along line 15—15 in FIG. 14;

FIG. 16 is a partial view similar to FIG. 15 showing additional detail;

FIG. 17 is a cross-sectional view taken along line 17—17 in FIG. 15; and FIG. 18 is a partial view illustrating operation of the carrier shown in FIG. 14;

FIG. 19 is a partially fragmented view of the section of the back cover including a compartment for a wrench.

DETAILED DESCRIPTION OF THE PREFERRED EMBODIMENT

Figure 1:
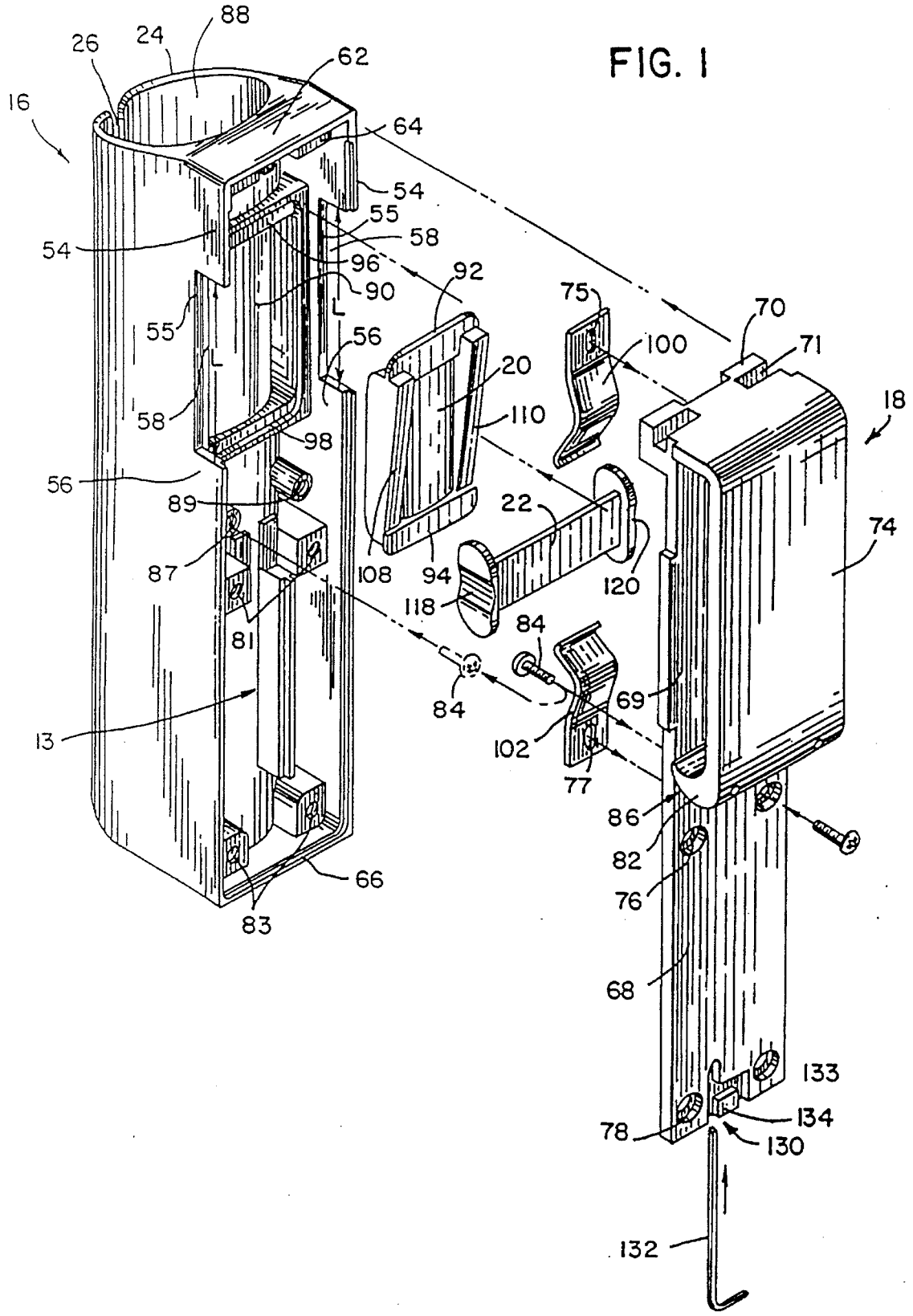
FIG. 1 is an exploded view of a baton carrier showing a baton holder, an attachment assembly and various components of the carrier according to the invention.
Figure 2:
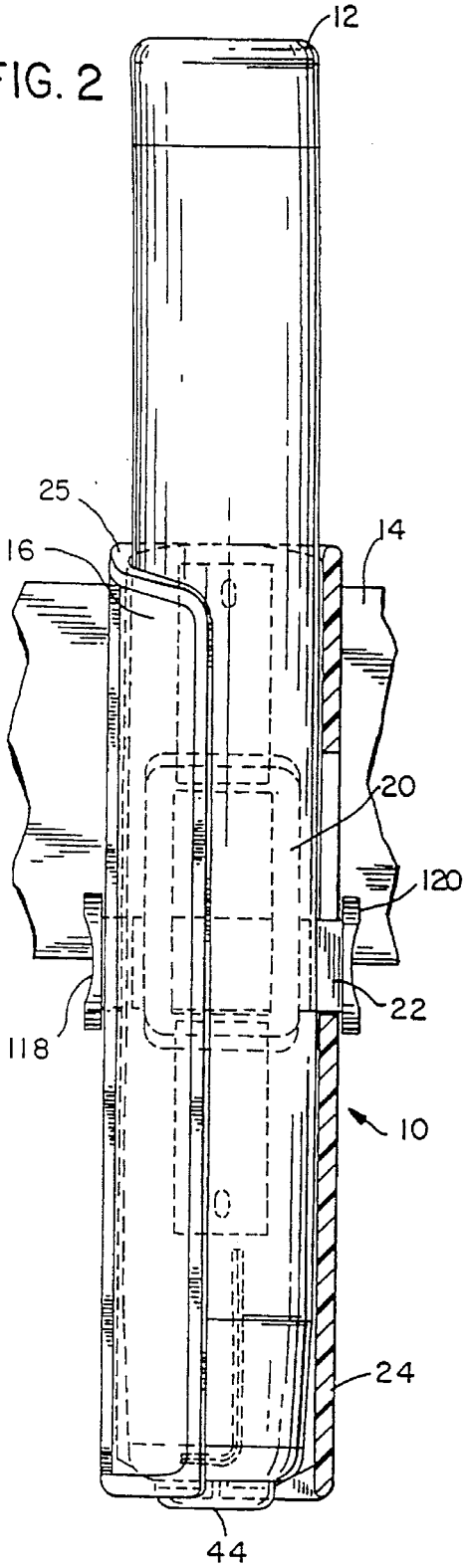
FIG. 2 is a front view of the baton carrier in which a retracted baton is stowed in the carrier.
Figure 3:
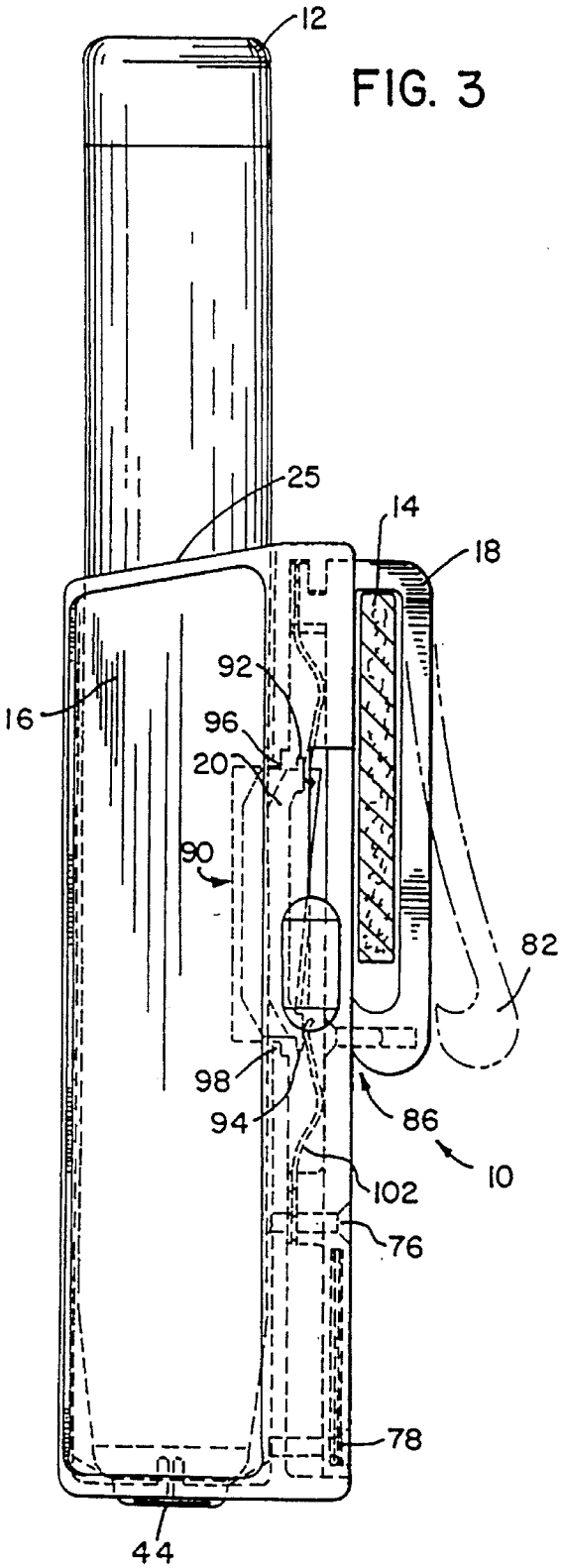
FIG. 3 is a side plan view of the baton carrier of FIG. 1.

Referring to FIGS. 1–3, the baton carrier 10 of the subject invention is generally comprised of four parts: a baton holder 16, an attachment member 18 for attaching the carrier 10 to a belt 14, a friction shoe 20, and a cinch bar 22 for pressing the friction shoe 20 against a baton 12 located in the baton holder 16.

The individual elements and assembly of the baton carrier 10 are shown in greater detail in FIG. 1. The baton holder 16 consists of a cylindrical wall 24 forming an interior chamber or passage 88 in which the baton 12 is placed. As shown in FIG. 1, the cylindrical wall 24 includes two walls 54 and 56 that extend tangentially from the cylindrical wall 24 in the direction of the attachment assembly 18. The attachment assembly 18 includes a back cover 68 with openings for receiving screws, a belt receiving loop 74 and an attachment lip 70 for ensuring that the assembly is securely fastened to the baton holder 16. In addition, the back cover 68 may include a compartment 130 for storing a wrench 132.

Referring to the baton holder 16, a guide slot 58 of length L is formed between the walls 54 and 56. In order to reinforce the structure of the baton holder 16, a brace 62 is included across the top edge of the walls 54 and a brace 66 connects the bottom edge of walls 56. The brace 62 also includes a reinforcement post 64. As shown in FIG. 1, the walls 54 and 56 and braces 62 and 66 create an inner chamber 13, for housing various components of the carrier 10, between the baton holder 16 and the attachment assembly 18.

The friction shoe 20 is located in the inner chamber 13 and includes a surface adapted to be pressed against the baton 12. The cylindrical wall 24 includes an opening 90 through which the friction shoe 20 extends into the interior passage 88 and is placed in contact with the baton 12. The side of the friction shoe 20 facing the assembly includes a ramped surface 108, 110 which corresponds to a ramped surface 116 on the cinch bar 22. The cinch bar 22 is also located within the inner chamber 13. The ends of the cinch bar 22 include finger grips 118 and 120 which extend outside of the inner chamber 13 and are used to move the cinch bar 22 along the guide slot 58. The movement of the cinch bar 22 urges the friction shoe 20 forward through the opening 90 to press against the baton 12 for securing the baton in the carrier 10. When the baton is not in the interior passage 88, the friction shoe is prevented from falling into the interior passage 88, when pressed forward, by lips 96 and 98 at the top and bottom of the opening 90 and the corresponding lips 92 and 94 on the top and bottom of the friction shoe 20.

Referring to the attachment assembly, the back cover 68 is shaped to fit against the walls 54 and 56 and encloses the inner chamber 13. The back cover 68 includes a projecting section 69 adapted to fit in the guide slot 58 while permitting enough space for the movement of the cinch bar 22 along the guide slot 58. The top of the back cover 68 includes an attachment lip 70 and a notch 71, adapted to receive the reinforcement post 64, for securing the attachment assembly 18 to the holder 16. In addition, the back cover 68 includes elongated posts 72 and 73 for securing springs 100 and 102. As seen in FIG. 1, springs 100 and 102 include elongated slots 75 and 77 at one end for receiving the posts 72 and 73. When assembled, springs 100 and 102 exert pressure against the friction shoe 20 and prevent it from falling into the inner chamber 13.

The attachment assembly 18 is further secured to the baton holder 16 by screws 76 and 78. As shown in FIG. 1, the inner chamber includes openings 81 and 83, corresponding to the openings in the back cover 68, for receiving the screws 76 and 78. The belt receiving loop 74 is J-shaped and is permanently secured at the top end of the assembly 18. Moreover, the lower end 82 of the loop 74 may be secured to the back cover 68 with screws 84 and 85. As indicated in FIG. 1, the inner chamber 13 includes compartments 87 and 89 for storing the screws 84 and 85 when not in use. The baton carrier 10 may be disassembled by removing screws 76 and 78 to remove the back cover 68. Thus, a compartment 130 for carrying equipment such as a wrench 132 is included for removing the screws. The compartment consists of a groove in the interior of the back cover 68 and a ledge 134 at the bottom of the compartment. As shown in FIGS. 1 and 19, the wrench 132 is placed in the compartment 130 so that the upper portion of the L-shaped wrench is concealed within the back cover 68 and the lower end of the wrench 132 is visible and resting on the ledge 134.

Referring now to FIGS. 2 and 3, a baton carrier 10 (generally) is shown holding an expandable baton 12 which is retracted. The carrier 10 is clipped on to a belt 14 that would typically be around the waist of a person wearing the belt 14. Molded plastic is an appropriate material for most of the parts of the carrier 10 excluding screws and springs. This is because small parts made of molded plastic are rigid, and large parts made of molded plastic can be sufficiently rigid, yet bendable and resilient.

The cylindrical wall 24 of baton holder 16 has a longitudinal slit or opening 26 (see FIGS. 4, 8, 9 and 10). The slit 26 runs the entire longitudinal length of the cylindrical wall 24. The open top 25 of the cylindrical wall 24 is slanted such that the top 25 is lowest by the longitudinal slit 26 and is highest toward the attachment member 18 on the side of the slit 26, or displaced at an approximately right angle to the slit.

The baton holder 16 also has a substantially closed bottom 28 with a through hole 30. Referring to FIG. 4, the bottom 28 also has a plurality of slits 32, 34, 36 and 38. Slits 34, 36 and 38 extend radially from the hole 30 toward the cylindrical wall 24. Slit 32 extends from the hole 30 into the longitudinal slit 26 in the cylindrical wall 24 to define a continuous opening along the length of the longitudinal slit 26 and the bottom slit 32. Raised ribs or curbs 40 are located on the bottom 28 adjacent to each slit 32, 34, 36, and 38 and project upwardly into the baton chamber. The ribs supply additional strength to the bottom 28. The ribs 40 slope downwardly from the wall 24 of the cylinder toward the center of the hole 30. This provides a sloped seating surface for seating the baton in alignment with the axis of the chamber.

The bottom 28 is designed such that the hole 30 of a diameter slightly smaller than the maximum diameter of the baton tip 44, assuring that the baton as retracted does not extend through the bottom of the carrier. Thus, the retracted baton 12 is fully supported by the bottom 28 of the carrier (see FIGS. 2 and 3). It is desirable to provide a slight radius on the upper circumferential lip of the hole 30 to assure proper seating of the baton tip 44 in the hole.

The radial slits 32, 34, 36 and 38 permit the hole to be selectively expanded. Once the baton is expanded (see FIGS. 9, 10, and 11) the tip 44 can be forced through the expandable hole 30, as well as the telescoping shafts 42 and 48. Referring to FIG. 8, an expanded baton 12 can be pushed down against the ribs 40 to push out the cylindrical wall 24 and expand the hole 30 along the radial slits in the bottom 28 so that the innermost shaft 42 of the baton 12 can pass through the hole 30. After the tip 44 located at the end of the innermost shaft 42 passes through the hole 30, the cylindrical wall 24 generally springs back to its original position because the diameter of the hole 30 is typically larger than the diameter of the innermost shaft 42 of the baton 12.

Figure 10:
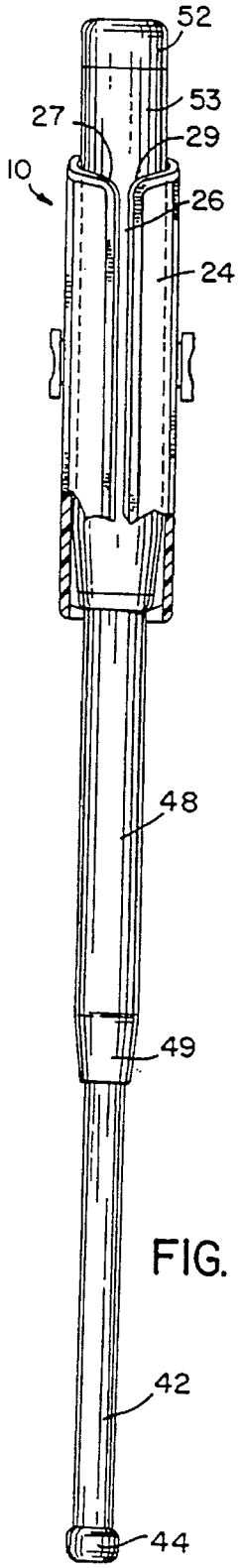

Referring to FIG. 10, the hole 30 is preferably sized so that the middle shaft 48 of the baton 12 can be passed through the hole 30 so that the base 50 of the handle 52 of the baton 12 abuts the ribs 40 in the same manner as when the baton is fully retracted as in FIGS. 2 and 3. Preferably, the middle shaft 48 of the baton 12 includes a tapered outer end 49. This assists in spreading the hole 30 to accommodate the middle shaft 48 of the expanded baton for proper seating or holstering of the expanded baton as shown in FIG. 10.

Figure 11:
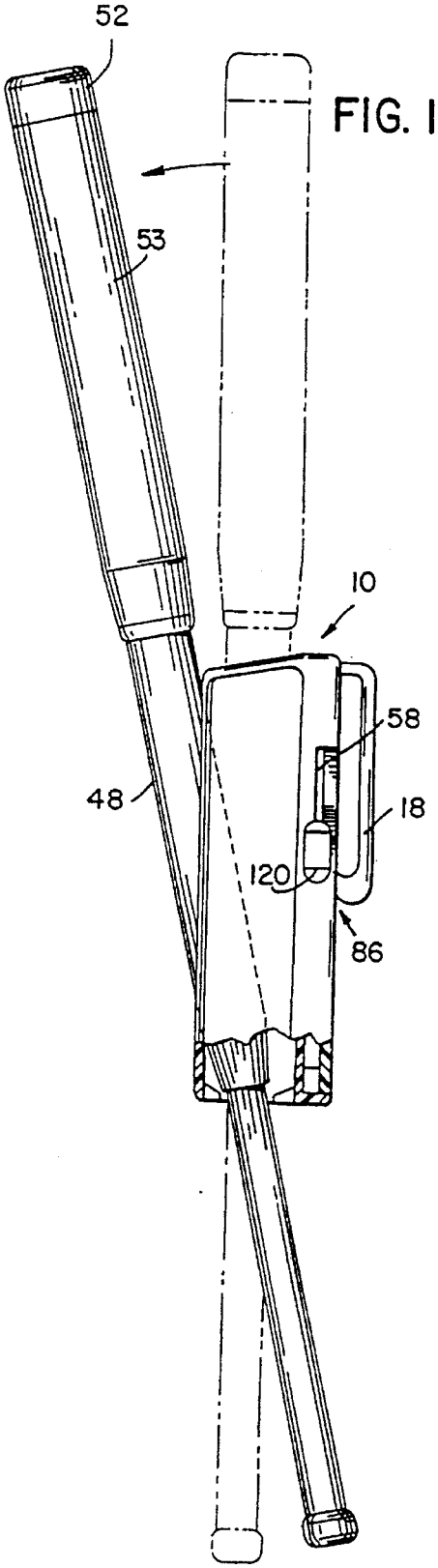

When a baton 12 is carried in the carrier 10 as depicted in FIG. 10, the baton 12 can be drawn by gripping the baton handle 52, pulling the baton 12 axially upward, and once the handle has cleared the top 25 of the cylinder, then moving the baton 12 through the longitudinal slit 26 in the cylindrical wall 24 of the holder 16, as depicted in FIG. 11. Of course, the expanded baton can also be fully axially withdrawn. Therefore, the initial drawing action for withdrawing both the retracted or the expanded baton from the carrier is an axial motion to free the handle 52 from the carrier. It has been found that the subsequent lateral or radial motion to free the telescoped sections 42 and 48 is a natural movement, making the carrier easy to adapt to and use. It should be noted the middle 48 and the innermost 42 shafts of the baton 12 can be forced through the slit 26 primarily because the walls 24 of the holder 16 flex when sideways pressure is applied. The shafts 48 and 42 are metal and can slide through the slit 26 when the walls 24 flex. The handle 52, on the other hand, is of sufficient diameter that it is beyond the range of flex of the slit 26. In addition, the handle is generally provided with a friction grip surface such as a foam sleeve 53, or the like, further restricting the radial motion of the handle 52 through the slit.

It is preferred that the cylindrical wall 24 be of molded plastic (e.g. Delrin or the like) having a thickness of 40 to 80 mils. Referring to FIGS. 8 and 15, the cylindrical walls 24 can be made with recesses 27 in which another non-supporting material such as leather 29 may be placed.

Note that the slanted top 25 of the cylindrical wall 24 extends to the longitudinal slit 26 where radiused corners 27 and 29 are formed (see FIG. 10). Both the slanted top 25 and the rounded corners 27 and 29 facilitate easy removal of an expanded baton 12 through the longitudinal slit 26.

The above described construction provides a practical way to store and access an expandable baton 12 whether the baton 12 is retracted or expanded. It is important to emphasize that the manner of drawing an expanded baton 12 is similar to the manner of drawing a retracted baton 12. If the baton 12 is retracted, the user can easily pull the baton 12 up and out of the holder 16. If the baton 12 is expanded, the baton 12 can be drawn by pulling the baton 12 up and sliding the baton 12 through the longitudinal slit 26 as shown in FIG. 11.

Figure 14:
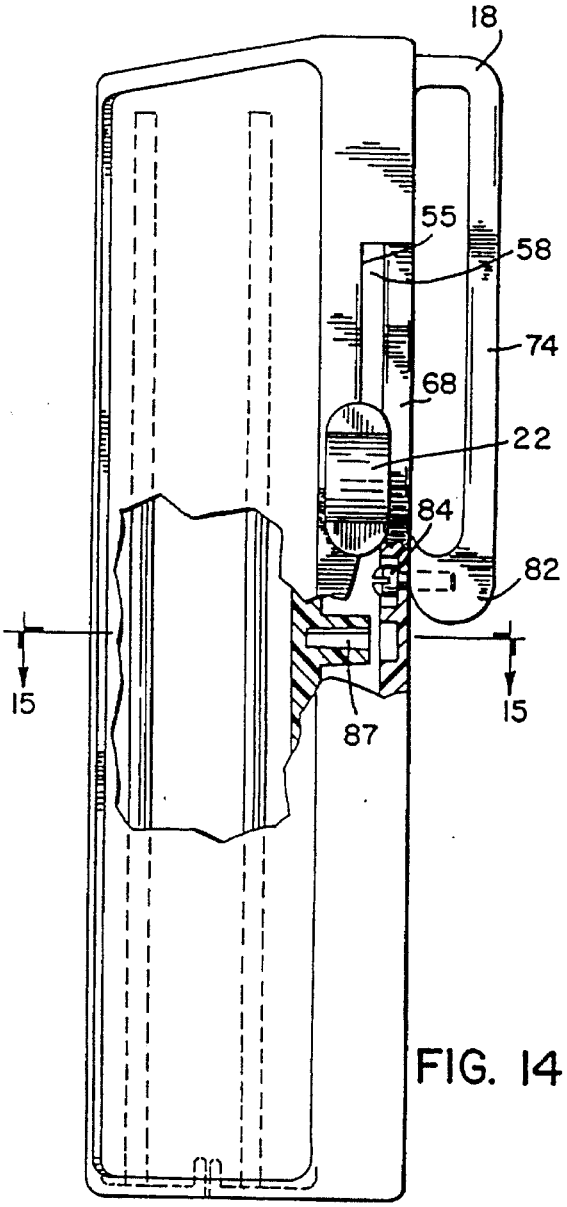
FIG. 14 is a side plan view of another embodiment of the invention.
Figure 9:
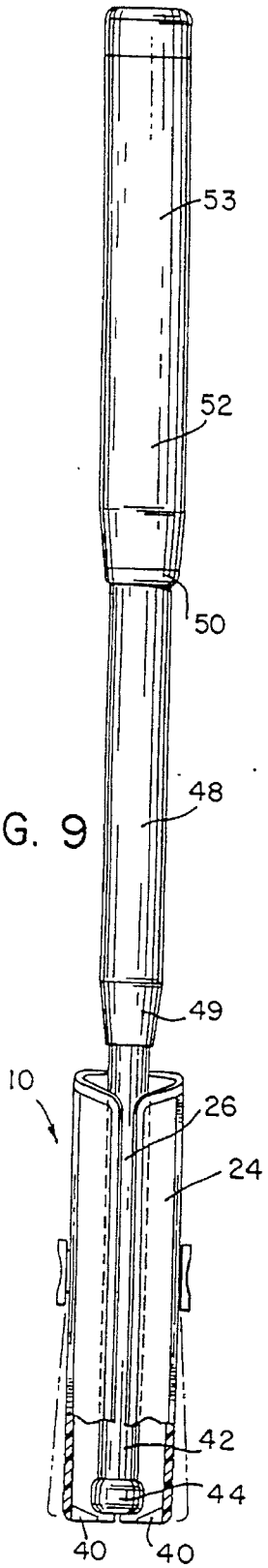
FIGS. 9–11 are side plan views illustrating the operation of the carrier with an expanded baton.

Referring now to FIGS. 4 and 8, the baton holder 16 has two walls 54 and 56 that extend tangentially from the cylindrical wall 24 in a direction away from the longitudinal slit 26. The walls 54 and 56 extend longitudinally along a substantial portion of the length of the baton holder 16. As best seen in FIG. 14, there is a recess 55 provided along the middle of the walls 54 and 56 to form a portion of a guide slot 58. The remainder of the guide slot 58 is formed by a projecting section 69 in a back cover 68 of the attachment member 18. A cinch bar 22 is positioned in the guide slot 58.

Figure 7:
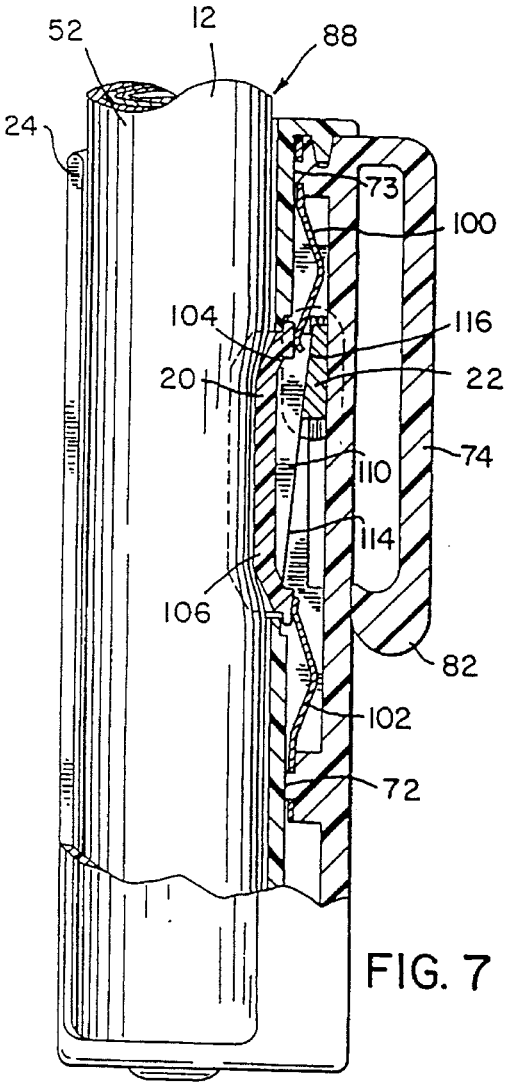
FIG. 7 is a view similar to FIG. 6 showing the locking cinch bar in the locked position.

Referring to FIG. 7, a baton 12 can be positively secured in the holder 16 either when it is retracted or expanded by using the friction shoe 20 to apply pressure against the handle 52 when the baton is seated in the interior passage 88 within the cylindrical wall 24. Note that the friction shoe 20 pushes in the foam grip handle 53 slightly to positively secure the baton 12 in the carrier 10.

The friction shoe 20 is spring loaded, as will now be explained, in order to press the shoe against a baton 12 located in the interior passage 88. Further, as will also be explained, the cinch bar 22 may be used to selectively lock the friction shoe 20 in the interior passage 88 through an opening 90 in the cylindrical wall 24. The opening 90 is located on the cylindrical wall 24 towards the back cover 68 of the attachment member 18 and opposite from the longitudinal slit 26 of the cylindrical wall 24. As can be seen in FIG. 8, the friction shoe 20 has a face 92 with a shape corresponding generally to the circumference of the handle 52 of the baton 12.

Referring again to FIG. 5, the friction shoe 20 is prevented from falling into the interior passage 88 by lips 92 and 94 located at the top and the bottom of the friction shoe 20. Corresponding lips 96 and 98 located on the cylindrical wall 24 at the top and bottom of the opening 90 interfere with lips 92 and 94 on the friction shoe 20, and prevent the friction shoe 20 from falling into the interior passage 88. Since the cylindrical wall 24 is used to prevent the friction shoe 20 from falling into the interior passage 88, the friction shoe 20 is shaped so that the face 92 can extend into the interior passage 88 even when the lips 96 and 98 around the opening 90 in the cylindrical wall 24 stop further movement of the friction shoe 20 toward the interior passage 88.

As best seen in FIGS. 5, 6, 7 and 13, springs 100 and 102 keep the friction shoe from falling out of the opening 90 and toward the back cover 68. The springs 100 and 102 are held in place by the elongated posts 72 and 73, respectively. The springs 100 and 102 are each secured at one end on the respective post 73 or 72, and are free at the other end so that each can move with the friction shoe 20. Springs 100 and 102 have elongated holes or slots 75 and 77 corresponding to and adapted for receiving the posts 73 and 72 so the springs can be secured by placing the posts 73 and 72 through the springs 100 and 102 as shown in FIGS. 5, 6, and 7. The oblong shape of the posts 73 and 72 restricts the springs from rotating sideways around the posts 73 and 72.

FIG. 5 shows a carrier 10 without a baton 12 located in the interior passage. Note that in FIG. 5, the springs 100 and 102 keep the friction shoe 20 pushed into the interior passage 88. When a baton 12 is inserted into the interior passage 88 as shown in FIG. 6, the baton 12 pushes the friction shoe 20 towards the back cover 68 against the force of springs 100 and 102.

The friction shoe 20 has two pushing walls 108 and 110 on the side of the friction shoe 20 facing the back cover 68 (see FIG. 8). Each of the pushing walls 108 and 110 has a ramped surface 112 and 114, respectively. Each of the ramped surfaces 112 and 114 is slanted linearly in such a manner that the pushing walls 108 and 110 are shorter at the low end of the friction shoe 20 and longer at the top end of the friction shoe 20 (see FIGS. 5, 6 and 7).

The cinch bar 22 has a corresponding ramped surface 116 (see FIG. 5) that is for pushing against the ramped pushing walls 108 and 110 of the friction shoe 20 to push the friction shoe 20 into the interior passage 88. Referring to FIG. 8, the cinch bar 22 has two finger grips 118 and 120 attached to the ends of the cinch bar 22. The finger grips 118 and 120 allow the wearer to easily pull the bar 22 upward into guide slot 58. The ramped surface 116 on the cinch bar 22 is located on the side of the cinch bar 22 facing the friction shoe 20. The slant on the ramped surface 116 on the cinch bar 22 is linear, but is opposite from the slant of the ramps 112 and 114 on the pushing walls 108 and 110 of the friction shoe 20. That is, the ramp 116 on the cinch bar 22 is largest at the bottom and is a reducing taper toward the top. The ramp 116 on the cinch bar 22 extends most of the length of the cinch bar 22, but need not extend completely to the finger grips 118 and 120 of the cinch bar 22. Rather, the ramped surface 116 extends up to a small distance before the walls 54 and 56 on the baton holder 16. The width of the guide slot 58 is slightly larger than the width of the cinch bar 22 less the width of the ramp 116. The cinch bar 22 is thereby prevented from twisting in slot 58.

The cinch bar 22 can be moved upward in slot 58 so that the ramp 116 on the cinch bar 22 pushes against the conversely ramped pushing walls 108 and 110 on the friction shoe 20, and in turn pushes the face 92 of the friction shoe 20 against a baton 12 located in the interior passage 88 of the baton holder 16. As seen in FIG. 7, the cinch bar 22 has been lifted in the guide slot 58, and the cinch bar 22 is pushing against the friction shoe 20 which in turn pushes against the handle 52 of the baton 12. A catch such as, by way of example a friction stop or a detent mechanism, may be employed with the cinch bar to lock it in position, particularly when it is in the downward, loose position, thus assuring against rattling or other undesirable movement.

In order to release pressure from the friction shoe 20 on the handle 52 of the baton 23, the cinch bar 22 can be pushed downward in slot 58. It is preferred that the direction of release be downward because in an emergency an upward motion may raise the entire belt 14 of the wearer and make such release difficult. Note that the carrier 10 can accommodate batons 12 having various diameters by replacing the friction shoe 20 with a friction shoe of a different size or shape. For instance, the carrier 10 can accommodate a baton 12 having a very small diameter if the shoulders 104 and 106 of the friction shoe 20 are extended further toward the interior passage 88 so that the front face 92 of the friction shoe 20 resides deeper in the interior passage 88.

Figure 12:
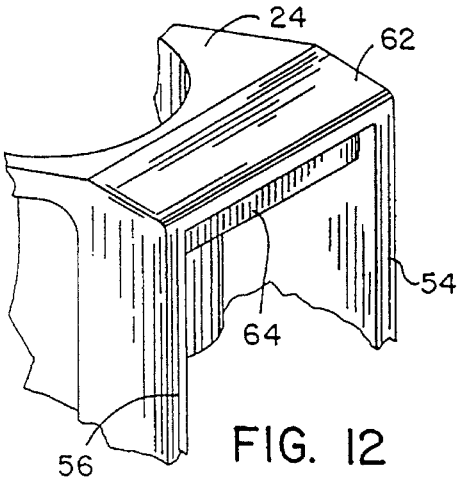
FIG. 12 is a partial perspective view showing a reinforcement element on the carrier.

Referring to FIGS. 5 and 12, a brace 62 spans between the walls 54 and 56 and the cylindrical upper wall 24 on the holder 16. A reinforcement post 64 extends downward from the brace 62 and runs the span of the brace 62 between the walls 54 and 56. A lower brace 66 is also provided between the bottom of walls 54 and 56 and the bottom of the cylindrical wall 24. The braces 62 and 66, coupled with the post 64 further reinforce and strengthen the carrier assembly.

Figure 13:
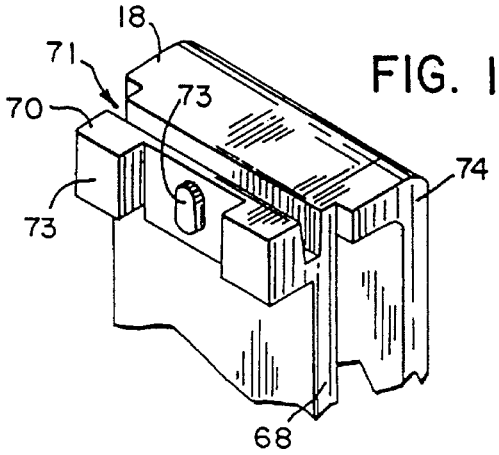
FIG. 13 is a partial perspective view showing additional detail of the reinforcement element.

Referring now to FIGS. 5 and 13, the attachment assembly 18 includes a back cover 68 and a belt receiving loop 74. An attachment lip 70 is provided at the top of the back cover 68 to ensure that the back cover 68 is securely fastened to the holder 16. The attachment lip 70 has a notch 71 that is sized to accept the reinforcement post 64. The attachment assembly 18 is connected to the baton holder 16 by first fitting notch 71 over post 64. The attachment member 18 is then secured to the baton holder 16 by suitable means such as by way of example, the screws 76 and 78. When the back cover 68 is attached in this manner, the face 73 of the attachment lip 70 presses against the holder 16 so the lip 70 does not bear excessive pressure.

The belt receiving loop 74 is formed integrally with the top of the back cover 68. The belt receiving loop 74 has a lower end 82 that is designed to be bowed slightly away from the cylinder and the back cover 68. Referring to FIGS. 14 through 18, two screws 84 and 85 are optional to connect the back cover 68 to the lower end 82 of the belt receiving loop 74. The lower end 82 of the belt receiving loop 74 is J-shaped so that the belt receiving loop 74 can be easily slipped onto a belt 14. The screws can then be used to tighten down the loop against the belt. Even when the screws 84 and 85 are not used, the J-shape also makes it difficult for the carrier 10 to inadvertently fall off of a belt 14. However, the tighten down feature of the screws assures against lateral slippage of the carrier along the belt. To remove the carrier 10 from a belt 14 when screws 84 and 85 are not used, a wearer must ordinarily pull the loop 74 away from the back cover 68 and slip the belt 14 through an opening that would be created at point 86.

When screws 84 and 85 are not used, they can be stored in compartments 87 and 89, as shown in FIGS. 16 and 18. Screws 84 and 85 can be put into or taken out of compartments 87 and 89 by removing the back cover 68. It is preferred that the compartments 87 and 89 comprise a threaded portion 91 and 93 in the back cover 68, and a space 95 or 97 for the heads of the screws 84 and 85. The threads 91 and 93 prevent the screws 84 and 85 from rattling when they are being stored.

As stated, the screws 84 and 85 may be used to securely close the loop 74. When screws 84 and 85 are used, the carrier 10 cannot be slipped onto a belt 14 through opening point 86, but a belt 14 must be threaded through the opening 88 located within loop 74.

Since the attachment member is connected to the baton holder 16 with screws 76 and 78, the attachment member 18 can be replaced with a new or modified attachment member 18. This is useful in case the attachment member 18 breaks, or the wearer desires to have an attachment member with a modified configuration such as a different sized belt receiving loop 74.

As is best shown in FIGS. 1 and 16, the screws may be stowed in compartments 87 and 89. Typically, allen head screws are preferred, but others may be substituted. As shown in FIGS. 1 and 19, the back cover 68 may include a separate compartment 130 adapted for seating and stowing a compatible allen wrench 132 so that the wrench is always available, being stored in the carrier. The compartment 130 is designed to provide a snug fit with the wrench 132 and includes a ledge 134 for retaining the wrench in the compartment 130. As best shown in FIGS. 1 and 19, the compartment 130 includes an elongated vertical slot 131 for receiving the wrench 132. After the wrench 132 is inserted into the slot 131, it is rotated so that the bottom of the "L" shaped wrench rests on the ledge 134. A second channel 133 is provided for receiving a release tool (not shown) for removing the wrench 132 from the compartment 130. The release tool is received into the second channel 133 and used to rotate the "L" portion of the wrench 132 away from the ledge 134 thereby allowing the wrench to slide out of the slot 131 in the same manner in which it was inserted. Although any suitably pointed object may be used as a release tool, a double lock mechanism tool used in connection with handcuffs is ideal for releasing the wrench 132 since it is typically already carried by law enforcement personnel.

An alternative embodiment of the invention is shown in FIGS. 14–18 and is particularly well-suited for a baton of a smaller overall diameter. As there shown, the cylindrical wall 24 is provided with longitudinal ribs 117 extending lengthwise along the inner surface 119 of the wall 24. The ribs 117 allow a baton 12 having a smaller diameter to be supported, while at the same time allowing the remainder of the holder 16 to be the same size as the unribbed version (see FIG. 8). Thus, the ribbed holder 16 is physically compatible with the other components of the carrier 10 as shown in FIGS. 2–13, greatly reducing any difference in manufacturing methods and costs. Also, the use of ribs 117 does not significantly change the flexibility of the cylindrical walls 24. As a further cost cutting feature, it has been found that removable mold insert can be used for supplying a desired finish or pattern on the exterior surface of the cylinder wall. For example, some agencies prefer a matted finish while others may prefer a high-gloss exterior. By employing interchangeable inserts, the exterior can be provided with any of a wide variety of finishes without greatly affecting the costs of manufacture.

While certain embodiments and features of the invention have been disclosed in detail herein, it will be understood that the invention encompasses all enhancements and modifications within the scope and spirit of the following claims.

What is claimed is:

1. A baton carrier for holding an expandable baton, the baton carrier comprising:

a. a baton holder having a cylindrical wall defining a cylinder having an interior chamber for receiving an expandable baton substantially along a longitudinal axis of the interior chamber, the wall having a longitudinal opening therein;

b. a rigid baton securing element having an interior face extending into the interior chamber of the holder and contoured to generally conform to the interior wall of the cylinder and an outer surface disposed opposite the interior face, wherein the outer surface is tapered to form a ramp facing away from the interior chamber, said rigid securing element positioned in the opening of the cylindrical wall and mounted for selective radial movement relative to the axis of the cylinder, whereby the rigid securing element can be displaced into and out of the interior chamber of the holder;

c. a compression biasing member for urging the rigid securing element into the interior chamber of the holder for pressing against a baton therein;

d. a movable cinch bar disposed in engagement with the ramp and adapted to force the rigid element into the interior chamber when the cinch bar is moved along the ramp; and e. a guide slot on the holder for guiding the movement of the cinch bar in a direction substantially parallel with the longitudinal axis of the interior chamber of the holder, whereby the securing element is displaced into the interior chamber of the holder as the cinch bar moves in a direction defined by the guide.

2. A baton carrier as recited in claim 1, wherein the cinch bar is tapered in a direction opposite the ramp on the outer surface of the rigid securing element.

3. A baton carrier as recited in claim 1, further including means for selectively locking the cinch bar in a predetermined position relative to the rigid securing element.

4. A carrier for holding a law enforcement article on a user's belt, the carrier comprising:

a holder having a wall defining an interior chamber for receiving an article substantially along a longitudinal axis of the interior chamber, the wall having a longitudinal opening therein;

b. a rigid securing element having an inner surface facing into the interior chamber for engaging the article and an outer surface facing out of the chamber, said rigid securing element positioned in the opening of the wall and mounted for selective radial movement relative to the axis of the chamber, whereby the rigid securing element can be displaced into and out of the interior chamber of the holder;

c. a compression biasing member for urging the rigid securing element into the interior chamber of the holder for pressing against an article therein, said compression biasing member comprising a spring mounted in the carrier and engaging the outer surface of the rigid securing element; and d. a belt attachment assembly for carrying the holder on a users belt, the assembly attached to the holder and comprising a loop through which a belt is adapted to pass.

5. A carrier as recited in claim 4, wherein the rigid securing element further comprises:

a. an interior face extending into the interior chamber of the holder and contoured to generally conform to the interior wall of the holder; and b. the compression biasing member adapted for biasing the rigid securing element radially into the interior chamber.

6. A carrier as recited in claim 5, wherein the outer surface of the rigid securing element is disposed opposite the interior face.

7. A carrier as recited in claim 6, wherein the longitudinal opening has a top end and a bottom end and wherein the outer surface of the rigid element extends beyond and engages the top and bottom ends of the longitudinal opening for defining a positive stop to limit the movement of the rigid securing element into the interior chamber.

* * * * *